US005163298A

United States Patent [19]

Hassell et al.

[11] Patent Number: 5,163,298

[45] Date of Patent: Nov. 17, 1992

[54] ELECTRONIC ICE BANK CONTROL

[75] Inventors: David A. Hassell, Anoka, Minn.; Karl A. Senghaas, San Antonio, Tex.

[73] Assignee: IMI Cornelius Inc., Anoka, Minn.

[21] Appl. No.: 720,309

[22] Filed: Jun. 25, 1991

[51] Int. Cl.[5] ..... F25C 1/00

[52] U.S. Cl. ..... 62/59; 62/139

[58] Field of Search ..... 62/138, 139, 59

[56] References Cited

U.S. PATENT DOCUMENTS

| | | | |
|---|---|---|---|
| 3,496,733 | 2/1970 | Parker et al. | 62/139 |
| 3,502,899 | 3/1970 | Jones | 62/139 |
| 4,497,179 | 2/1985 | Iwans | 62/59 |
| 4,497,181 | 2/1985 | Kocher et al | 62/139 |
| 4,754,609 | 7/1988 | Black | 62/59 |
| 4,823,566 | 4/1989 | Chesnut | 62/139 |
| 4,843,830 | 7/1989 | Haul | 62/59 |
| 4,939,908 | 7/1990 | Ewing et al. | 62/139 |
| 5,022,233 | 6/1991 | Kirschner et al. | 62/139 X |

*Primary Examiner*—John Rivell

*Attorney, Agent, or Firm*—Sten Erik Hakanson

[57] ABSTRACT

The present invention is a method and apparatus for electronically controlling the size of an ice bank, particularly as used in beverage dispensing equipment. A single pair of probes provide for both establishing a reference conductivity value of the water so that the present invention is adaptable to a wide variance in water qualities. In addition, the single pair of sensors also provide for sensing the physical size of the ice bank.

8 Claims, 2 Drawing Sheets

ELECTRONIC ICE BANK CONTROL

FIELD OF THE INVENTION

The present invention relates to ice bank controls and, in particular, to electronic ice bank controls that reference the conductivity of the water.

BACKGROUND

Various mechanical and electronic ice bank controls are known in the prior art for maintaining a desired thickness of ice on a refrigerant evaporator coil. Such ice banks are primarily used in the beverage industry for providing a cooling source for dispensed soft drinks. Mechanical and electronic controls are known for maintaining the ice within a range of desired thickness. Electronic controls typically use a pair of probes suspended in a water bath adjacent the evaporator coils for determining the electrical resistance there between. Such probes take advantage of the fact that there exists a substantial conductivity difference between liquid water and ice. Thus, the cooling of the evaporator coil can be controlled in accordance with the sensed presence of liquid water or ice.

It is also well known that water varies greatly as to its conductivity depending on the source thereof. Various strategies have been employed to take into account this variation in water conductivity so that an ice bank can be formed of consistent size regardless of the water condition. Such a strategy can involve the use of two pairs of probes, one pair positioned so they remain continually in liquid water using these probes to generate this reference value, and the second pair for determining the ice bank size. In the interest of reduced cost and complexity, it would be very desirable to provide for such a reference value and for ice bank sensing from a single pair of probes.

SUMMARY OF THE INVENTION

The present invention comprises a control and method for electronically controlling the size of an ice bank. In particular, the control of the present invention utilizes a single pair of probes to both sense the physical dimension of the ice bank and to provide a reference value of the liquid water for providing useability to a wide range of water qualities.

The present invention includes a single pair of probes positioned in an ice bank adjacent an evaporator and positioned to sense ice at the desired ice bank size. The probes are connected to and operated by a microprocessor. The microprocessor is programmed to sense the conductivity at the probes when the unit is initially powered up. It will be understood that at initial power up the refrigeration system has not been running and, consequently, no ice has been formed. Therefore, it is assumed that the water at the probes is in liquid form. This conductivity value is stored in memory, providing that value is below a upper limit of 100K ohms. If this low set point value is less than or equal to 50K ohms, a low set point of 50K ohms is stored in memory. If the low set value is greater than 50K ohms, and less than 100K ohms, the reference value is stored at that value. Thus, the low set point value is established to be greater than or equal to 50K ohms and less than 100K ohms. As there is a marked difference in the conductivity of liquid water and ice, a high set point must be established with reference to the low value, which high set point will indicate the presence of ice. In the present invention, a high set point value was experimentally determined to equal the low set value plus 300K ohms. Thus, a sensor routine is periodically called and if the conductivity is greater than the high set point, the compressor is turned off indicating that there is sufficient ice on the ice bank and, conversely, if the conductivity is below the low set point, the compressor is turned on to enlarge the size of the ice bank. If the conductivity is between the low and high set points, no action is taken with respect to the operation of the refrigeration. It can be appreciated that the present invention provides for electronic ice bank control utilizing a single pair of probes.

BRIEF DESCRIPTION OF THE DRAWINGS

Further understanding of the objects and advantages and operation of the present invention can be had by reference to the following detailed description which refers to the following figures wherein.

DETAILED DESCRIPTION

Figure 1:
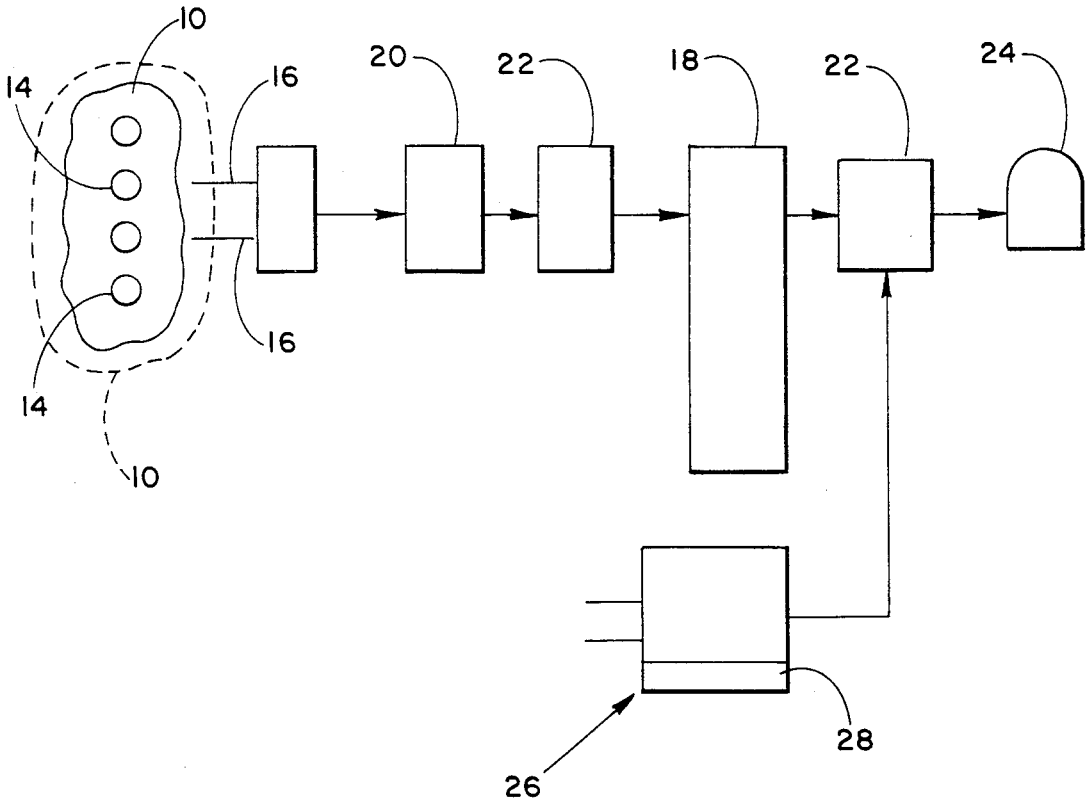
FIG. 1 shows a block diagram of the apparatus of the present invention.
Figure 2:
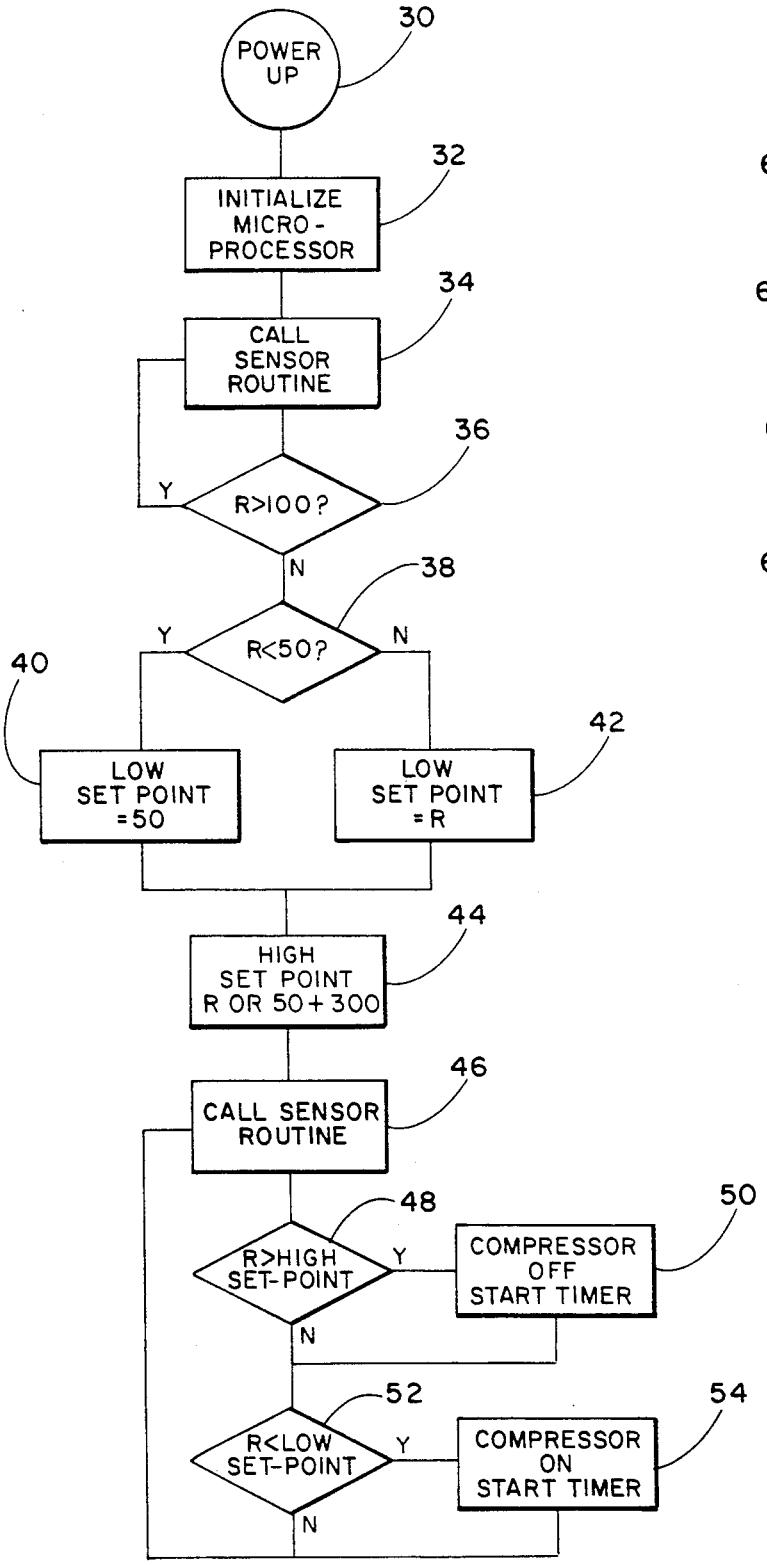
FIG. 2 shows a flow diagram for the determining of the high and low set points, and for the compressor control.

The control of the present invention as seen in FIG. 1 and includes an ice bank 10. As is known in the art, ice bank 10 is typically formed around a plurality of evaporator coils 14 submerged in a water bath (not shown). A pair of probes 16 are located in the water bath and secured adjacent coils 14. Probes 11 are connected to a microprocessor 18 via a signal conditioning circuit 20 and on analog digital conversion circuit 11. Microprocessor 18 is connected to a compressor switching control 22 for controlling the operation of a refrigeration compressor 24. A signal conditioning circuit 26 includes a synchronizing circuit 28 and is connected to a source of AC power for providing electrical current to microprocessor 18 and compressor 24. An understanding of the operation of the present invention can be had by reference to FIGS. 2 and 3, wherein FIG. 2 shows that at power up (block 30) the microprocessor 18 is first initialized (block 32). At (block 34) the sensor routine is again called and sensing continues until the conductivity reading is less than 100K ohms (block 36). At (block 38), if conductivity is less than or equal to 50K ohms, the low set point is set to equal 50K ohms (block 40) and, if greater than 50K ohms and less than 100K ohms, is set at that particular resistance (block 42). The high set point is determined at (block 44) by adding a value of 300K ohms to the low set point. At (block 46) the sensor routine is again called and the conductivity of probes 10 is sensed. If such conductivity is greater than the high set point (block 48) compressor 24 is turned off (block 50). If the conductivity is less than or equal to the low set point (block 52) this would indicate the presence of water in the vicinity of the probes and, thus, the compressor is turned on, (block 54), to generate more ice on the ice bank. It can be seen by reference to FIG. 2 that if the sensed conductivity is between the low and high set point, no action is taken. Thus, an initial reading is taken at start-up of the control apparatus, or one time following any subsequent removal of electrical power from the control. In particular, after an initial start-up or after a loss of power, blocks 32–44 are run once to establish a new high set point, after which point is established the routine then continues to run in the loop including blocks 46–54. It will be appreciated by those of skill that after a start-up block 36 does not permit the establishing of an artificially high low set-point value if, for example, an ice bank is present at an initial start-up such as after a power outage.

Figure 3:
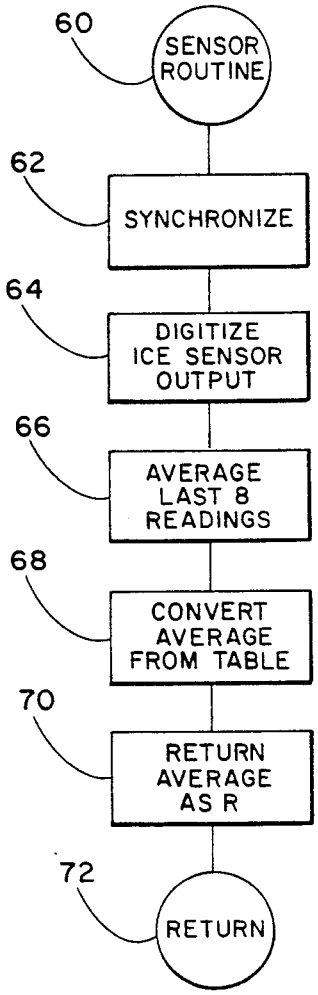
FIG. 3 shows a flow diagram of the sensor routine of the present invention.

The sensor routine of the present invention is seen in FIG. 3 and is initiated at (block 60). The sensor routine is synchronized by synchronizing circuit 28 with the incoming A/C power. As is understood by those of skill in the art, such synchronization provides for more accurate readings, which readings can be degraded somewhat by changes in incoming line frequency (block 62). The output of ice bank sensors 16 are then reviewed. In particular, at (block 64), the output of probes 16 is digitized. The digitized ice sensor output is added to an array of the last eight readings, over riding the oldest reading and calculating an average of those eight (block 66). At (block 68), this average reading is converted to an equivalent resistance from a look up table stored in microprocessor 18. This average water resistance is then used as the number for the particular resistance sensed at that time (block 70), and the newly calculated resistance value is returned to the appropriate point in the flow diagram of FIG. 2, (block 72).

It can be appreciated that the present invention provides a method and apparatus for electronically controlling the size of an ice bank through the utilization of only a single pair of ice bank probes. This is accomplished through establishing a reference value at a time when no ice can be present, such as the initial power up of the particular device.

We claim:

1. An apparatus for controlling the size of and ice-bank formed on a cooling coil, the cooling coil located in a water bath and connected to refrigeration means for cooling the coil, the control apparatus, comprising:

a pair of electrically conductive probes means, the probe means secured in the water bath adjacent the cooling coil, electronic control means, the control means connected to the probe means and the refrigeration means, the control means for sensing electrical conductivity of water in the water bath by determining electrical conductivity between the probe means, the control means sensing the conductivity between the probe means at an initial start-up and storing that initial start-up value and the control means adding a first predetermined value to the start-up value for calculating an ice-present value, the control operating the refrigeration means to cool the cooling coil for increasing the size of the ice-bank when the sensed electrical conductivity between the probe means is greater than or equal to the ice-present value and stopping the operation of the refrigeration means when the sensed electrical conductivity between the probe means is equal to or less than the start-up value.

2. The apparatus as defined in claim 1, and the control means not altering the operation of the refrigeration means if the sensed value is between the start-up value and the ice-present value.

3. The apparatus as defined in claim 1, and the control means including microprocessor means.

4. The apparatus as defined in claim 3, and the control means operated by alternating current and including synchronizing circuit means for synchronizing the operation of the micro-processor means with the frequency of the alternating current.

5. An apparatus for controlling the size of and ice-bank formed on a cooling coil, the cooling coil located in a water bath and connected to refrigeration means for cooling the coil, the control apparatus, comprising:

a pair of electrically conductive probes means, the probe means secured adjacent the cooling coil, electronic control means, the control means connected to the probe means and the refrigeration means and including micro-processor means, the control means for sensing electrical conductivity of water in the water bath by determining electrical conductivity between the probe means, the control means sensing the conductivity between the probe means at an initial start-up and storing that initial start-up value and the control means adding a first pre-determined value to the start-up value for calculating an ice-present value, the control operating the refrigeration means to cool the cooling coil for increasing the size of the ice-bank when the sensed electrical conductivity between the probe means is greater than or equal to the ice-present value and stopping the operation of the refrigeration means when the sensed electrical conductivity between the probe means is equal to or less than the start-up value.

6. The apparatus as defined in claim 1, and the control means not altering the operation of the refrigeration means if the sensed value is between the start-up value and the ice-present value.

7. The apparatus as defined in claim 5, and the control means operated by alternating current and including synchronizing circuit means for synchronizing the operation of the micro-processor means with the frequency of the alternating current.

8. A method for maintaining an ice-bank on a cooling coil, the cooling coil located in a water bath, the method comprising the steps of:

sensing the conductivity of water in the water bath at a point adjacent the cooling coil at an initial start-up, storing that initial conductivity start-up value, adding a pre-determined value to the start-up value for determining an ice-present value, sensing the conductivity of the water after initial start-up, cooling the cooling coil for increasing the size of the ice-bank when the sensed conductivity after start-up is greater than the ice-present value, and stopping the cooling of the cooling coil when the sensed conductivity after start-up is equal to or less than the start-up value.

* * * * *